United States Patent [19]

Kellner et al.

[11] Patent Number: 4,967,666

[45] Date of Patent: Nov. 6, 1990

[54] WARHEAD AGAINST FORTIFIED OR ARMORED TARGETS, PARTICULARLY FOR DAMAGING RUNWAYS, ROADWAY PAVINGS, BUNKER WALLS OR THE LIKE

[75] Inventors: Gerd Kellner, Aresing; Karl Rudolf, Edelshausen, both of Fed. Rep. of Germany

[73] Assignee: Messerschmitt-Bölkow-Blohm GmbH

[21] Appl. No.: 116,023

[22] Filed: Jan. 3, 1980

[30] Foreign Application Priority Data

Jan. 11, 1979 [DE] Fed. Rep. of Germany ..... 2900802

[51] Int. Cl.[5] ..... F42B 12/04; F42B 12/10; F42B 12/16

[52] U.S. Cl. ..... 102/476; 102/517; 102/701

[58] Field of Search ..... 102/52, 24 HC, 56 SC, 102/473, 475, 476, 501, 517–518, 519, 305, 306

[56] References Cited

U.S. PATENT DOCUMENTS

| | | | |
|---|---|---|---|
| 2,946,283 | 7/1960 | Udry | 102/318 |
| 3,416,449 | 12/1968 | Brothers | 102/476 |
| 3,495,532 | 2/1970 | Roberts et al. | 102/401 |
| 3,498,222 | 3/1970 | Birkigt | 102/518 |
| 4,063,512 | 12/1977 | Davis | 102/476 |

FOREIGN PATENT DOCUMENTS

| | | | |
|---|---|---|---|
| 971379 | 1/1981 | France | 102/56 |

*Primary Examiner*—David H. Brown
*Attorney, Agent, or Firm*—Toren, McGeady & Associates

[57] ABSTRACT

A warhead for use against fortified or armored targets has an axially extending common housing. A forward hollow charge is located in the housing adjacent the forward end. A follow-up projectile is located in the housing between the hollow charge and the rearward end. When the housing strikes a target an ignition system is activated first igniting the follow-up projectile and then igniting the hollow charge, so that the hollow charge opens a hole in the target and then is followed by the follow-up projectile aligned with the hole.

2 Claims, 1 Drawing Sheet

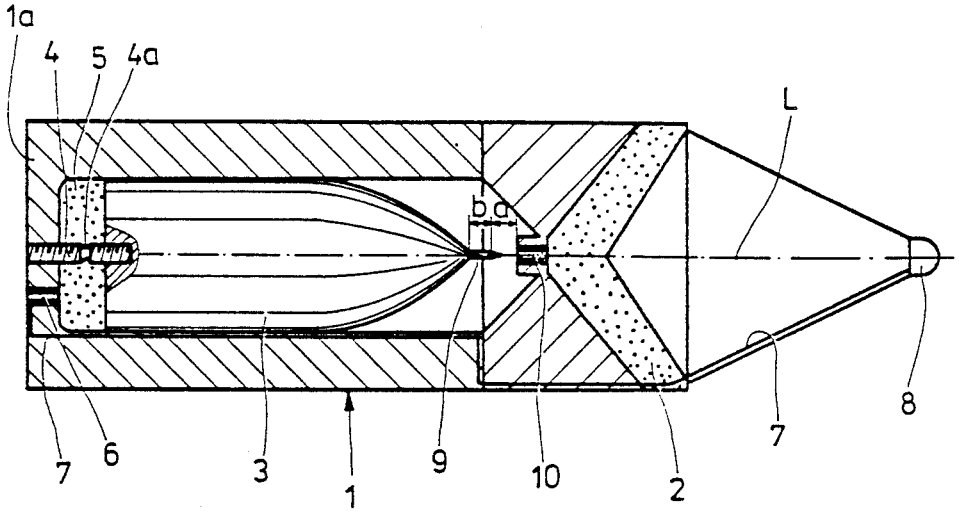
1a
4
5
4a
L
b
a
7
6
3
1
9
10
2
7
8

WARHEAD AGAINST FORTIFIED OR ARMORED TARGETS, PARTICULARLY FOR DAMAGING RUNWAYS, ROADWAY PAVINGS, BUNKER WALLS OR THE LIKE

The invention relates to a warhead against fortified or armored targets, particularly for damaging runways, roadway pavements, bunker walls or the like, composed of a forward hollow charge for breaking open the fortified ceiling or wall and a follow-up projectile which is guided in a common housing with a free spacing axially behind the hollow charge, the follow-up projectile reaching the interior of the target through the hole broken open by the forward hollow charge in the ceiling or wall and becoming effective in this interior.

In military technology, for combatting fortified and armored targets of the above-mentioned type, so-called tandem projectiles or tandem charges are known which, as shown, for example, in U.S. Pat. No. 3,495,532, are composed of a forward hollow charge and a projectile guided in a common housing with a free spacing behind the hollow charge. The hollow charge which is arranged at the front with respect to the military target has the purpose of breaking a hole in the armored wall of the target through which the rearward projectile accelerated by its own propellant charge, reaches the target space where it becomes effective. In the known case, the forward hollow charge is ignited prior to the propellant charge for the follow-up projectile.

This chronological constellation of the ignition of the hollow charge relative to the ignition of the propellant charge for the follow-up projectile results in the following disadvantages with respect to operation for the military effect of such a tandem charge:

In most cases, a hollow charge consists of a heterogenous mixture of explosives which is composed of a granular, solid high-power explosive, particularly hexogen, and a molten explosive component, particularly TNT. As is well known, it is impossible in practice to produce an absolutely homogenous hollow charge with respect to distribution of these two types of explosives in the charge body. Since this cannot be the case, the gas and smoke and the resulting explosion pressure generated during the detonation of the hollow charge are not developed dynamically balanced in the distribution over the circumference, so that, when the hollow charge is detonated, free transverse forces act on the warhead housing which causes the latter to be displaced or shifted transversely of its longitudinal direction. However, during this time, the spine generated by the detonation of the explosive charge in connection with the hollow charge lining, bores the intended hole in the wall or ceiling of the target. Due to the simultaneous, temporary shift of the warhead housing relative to the previously assumed longitudinal direction, the follow-up projectile accelerated by its own propellant charge is no longer able to find the just previously broken hole in the target wall or strikes against the edge region of the hole because of the axial shift and the new longitudinal direction of the warhead housing. This may even have the result that the follow-up projectile no longer reaches the interior of the target.

It is the object of the invention to avoid these disadvantages of the known concept and to adjust the time sequence of the ignition between the two individual projectiles, i.e. the forward hollow charge and the follow-up projectile arrranged behind the hollow charge in axial direction, so that it is guaranteed that the once assumed or desired target direction with respect to the bored hole is maintained.

In accordance with the invention, this object is met thereby that, in a warhead of the above-mentioned type, the propellant charge for the follow-up projectile is ignited first and the forward hollow charge is initiated only after the follow-up projectile has been put in motion.

The particular advantage of the invention resides in the fact that, when the hollow charge is detonated, the follow-up projectile has already reached its full velocity, at least already a high initial velocity, so that the transverse forces released by the asymmetry of the pressures of the gas and smoke are practically compensated by the kinetic energy of the follow-up projectile, whereby a high stability in the direction of the longitudinal axis of the projectile is achieved.

A positively timed sequence in the sense of the principal concept of the invention exists if, according to another feature of the invention, the forward hollow charge is ignited by the moving or advancing follow-up projectile without a deceleration of the velocity of the latter.

In executing the invention, for this purpose, the forward end of the follow-up projectile is provided with a piercing needle and the ignition device of the forward hollow charge is provided with a piercing point detonator which is to be initiated by this piercing needle, the piercing needle having such a length relative to the velocity of the follow-up projectile that the resulting travel time is at least equal to or particularly slightly greater than the ignition detonating time of the forward hollow charge.

As a result, it is ensured that the detonation procedure of the hollow charge is already concluded and the forward portion of the warhead is blasted away when the ogive of the follow-up projectile has reached this forward region, so that it has a clear path and can reach the hole duct bored by the spine of the hollow charge in an unobstructed manner, i.e. in longitudinal axis of the warhead.

Another feature according to the invention resides in the fact that the follow-up projectile is connected to the bottom of the warhead housing through a stay bolt with a central predetermined breaking point, the bolt bridging the mounting space for the propellant charge.

The drawing shows an embodiment according to the invention with the aid of a longitudinal section taken through a warhead in the form of a tandem projectile.

As illustrated in this drawings, in a common warhead housing 1, a hollow charge 2 is provided in the front and, behind the hollow charge 2 in the longitudinal axis L, a follow-up projectile 3 which may be constructed as an explosive projectile or a solid projectile. The follow up projectile 3 is connected to the bottom la of the warhead housing 1 through a central stay bolt 4 which has a central predetermined breaking point 4*a* and which bridges a free space for accommodating a propellant charge 5. The stay bolt 4 is tightly screwed to the bottom 1*a*, on the one hand, and to the rearward end of the follow-up projectile 3, on the other hand. The propellant charge 5 is ignited by an ignition system 6 which is connected, through an igniter line 7, to a percussion fuse 8 provided at the point of the warhead. At the front of the follow-up projectile, a piercing needle 9 is arranged as an ignition device, while a piercing point detonator 10 is provided on the hollow charge.

The warhead operates as follows:

When striking the target, for example, a concrete runway of an airport, the ignition system 6 is ignited by the percussion fuse 8 through the igniter line 7, the ignition system 6, in turn, igniting the propellant charge 5. The gases of the propellent charge 5 propel the follow-up projectile 3 toward the front, and the stay bolt 4 breaks at the predetermined breaking point 4*a*. After the follow-up projectile 3 has reached a velocity or force which is stabilizing for the tandem projectile—this takes place at least along the distance a—the piercing needle 9 enters the piercing point detonator 10 which is thereby pyrotechnically ignited by the generated pressure and heat due to friction. The piercing needle 9 has such a length b relative to the velocity of the follow-up projectile 3 that the resulting travel time is at least equal to or particularly slightly greater than the ignition and detonation period of the forward hollow charge 2. As a result, it is guaranteed that the forward portion of the warhead which surrounds the hollow charge 2 is removed by the explosive action of this hollow charge 2, so that not only the warhead remains axially aligned with respect to the hole in the ceiling or wall of the target bored by the hollow charge as a result of the kinetic stabilizing effect of the moving follow-up projectile 3, but that also the path to this bored hole remains clear for the following follow-up projectile.

What is claimed is:

1. Warhead against fortified or armored targets, particularly for damaging runways, roadway pavements, bunker walls or the like, comprising an axially extending common housing having a forward end and a rearward end, a forward hollow charge extending in the axial direction of said common housing for breaking open the fortified ceiling or wall located within and adjacent the forward end of said common housing, and a follow-up projectile extending in the axial direction of said common housing and which is guided said common housing at a free spacing axially behind said hollow charge and a propellent charge for additionally accelerating said follow-up projectile, said follow-up projectile arranged to reach the interior of the target through the hole broken open by said forward hollow charge in the ceiling or wall and to become effective in the interior of the target, means for initially igniting said follow-up projectile when said common housing strikes at the forward end thereof against a target so that said follow-up projectile is accelerated toward the forward end of said common housing and ignites said hollow charge so that said hollow charge forms a spine for cutting a hole in the target characterized in that said follow-up projectile has a piercing needle at the forward end thereof, said hollow charge has a piercing point detonator at the rearward end thereof spaced forwardly from said piercing needle and said piercing needle having a length relative to the velocity of said follow-up projectile so that the resulting travel time is at least equal to or slightly greater than the ignition and detonation period of said hollow charge.

2. Warhead according to claim 1, characterized in that said follow-up projectile 3 is connected to the rearward end of said common housing 1 by at least one stay bolt 4 having an average predetermined breaking point 4*a*, and said at least one stay bolt 4 bridges a mounting space for said propellant charge 5 for said follow-up projectile.

* * * * *